US007494210B2

(12) United States Patent
Yamada et al.

(10) Patent No.: US 7,494,210 B2
(45) Date of Patent: Feb. 24, 2009

(54) INKJET RECORDING HEAD HAVING DYNAMIC VIBRATION ABSORBER

(75) Inventors: Takahiro Yamada, Hitachinaka (JP); Toshiharu Sumiya, Kawasaki (JP); Tomohiko Koda, Hitachinaka (JP); Shinya Kobayashi, Hitachinaka (JP); Satoru Tobita, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 316 days.

(21) Appl. No.: 11/179,807

(22) Filed: Jul. 13, 2005

(65) Prior Publication Data

US 2006/0012647 A1 Jan. 19, 2006

(30) Foreign Application Priority Data

Jul. 15, 2004 (JP) ..... P2004-208070

(51) Int. Cl.
*B41J 2/045* (2006.01)
*B41J 2/17* (2006.01)

(52) U.S. Cl. ..... 347/71; 347/94

(58) Field of Classification Search ..... 347/70–72, 347/94

See application file for complete search history.

(56) References Cited

U.S. PATENT DOCUMENTS 3,786,202 A * 1/1974 Schafft ..... 310/324
5,541,630 A * 7/1996 Ema et al. ..... 347/70
6,478,411 B2 * 11/2002 Kitahara ..... 347/70

FOREIGN PATENT DOCUMENTS

JP 02081637 A * 3/1990
JP 06206310 A * 7/1994
JP 6-270403 9/1994
JP 2002-361868 12/2002

* cited by examiner

*Primary Examiner*—Luu Matthew
*Assistant Examiner*—Lisa M Solomon
(74) *Attorney, Agent, or Firm*—Whitham Curtis Christofferson & Cook, P.C.

(57) ABSTRACT

An inkjet recording head includes a base member, an ink channel unit, a plurality of piezoelectric elements, and a dynamic vibration absorber. The ink channel unit is formed with a plurality of nozzle holes and a plurality of ink pressure chambers. The ink channel unit includes a diaphragm that defines part of each ink pressure chamber. Each piezoelectric element has one end fixed to the base member and another end attached to the diaphragm. Each piezoelectric element generates displacement in a displacement direction for deforming the diaphragm to eject ink droplets through a corresponding one of the plurality of nozzle holes. The dynamic vibration absorber is mounted on the base member for damping vibrations of the base member due to a resonance, the resonance occurring in a frequency range less than or equal to a predetermined frequency.

15 Claims, 6 Drawing Sheets

INKJET RECORDING HEAD HAVING DYNAMIC VIBRATION ABSORBER

BACKGROUND OF THE INVENTION

1. Field of the Invention

The present invention relates to an inkjet recording head and inkjet recording device, and more particularly to an inkjet recording head and inkjet recording device capable of ejecting ink droplets by displacement of piezoelectric elements.

2. Description of Related Art

In order for on-demand inkjet recording heads having a plurality of nozzles to record high-quality images at a high speed and with excellent reliability, it is important to increase the ejection velocity of the ink droplets and to improve the stability of ejecting ink droplets at a high frequency.

One nozzle construction for ejecting ink droplets at a high ejection velocity and high frequency is disclosed in Japanese patent-application publication No. HEI-6-270403. In this "push" type piezoelectric element system, an ink chamber having orifices for nozzle holes includes a diaphragm serving as one wall of the ink chamber. Bar-shaped piezoelectric elements generate longitudinal vibrations that push the diaphragm, reducing the volume in the ink chamber and causing an ink droplet to be ejected through a nozzle hole.

In the push-type piezoelectric element system, the piezoelectric elements are arranged in a row having a number of elements at least equivalent to the number of nozzles. The piezoelectric elements are fixed to a base member on the opposite side from the diaphragm. The base member is then fixed by adhesive to a housing. In a recording head having this construction, the piezoelectric elements are driven by pulse signals applied according to an inputted recording signal. The longitudinal vibrations of the piezoelectric elements vibrate the base member, the head housing, and the like, resulting in instability in the ejection properties of the ink droplets To avoid this instability, a method disclosed in Japanese patent-application publication No. 2002-361868, for example, configures the base member with a member having relatively high rigidity in order to dampen vibrations generated by the piezoelectric elements.

SUMMARY

However, in trying to achieve an appropriate rigidity for conventional base members, various problems have occurred when ejecting ink droplets within a specific frequency range. For example, the conventional recording heads can generate ink mist, cause the trajectory of ejected ink droplets to deviate from the desired direction, cause ink to leak out of the nozzle hole and wet the periphery of the nozzle hole, result in ejection failure, and the like.

In view of the foregoing, it is an object of the present invention to provide an inkjet recording device capable of recording high-quality images at a high speed with excellent reliability.

In order to attain the above and other objects, according to one aspect, the present invention provides an inkjet recording head The inkjet recording head includes a base member, an ink channel unit, a plurality of piezoelectric elements, and a dynamic vibration absorber. The ink channel unit is formed with a plurality of nozzle holes through which ink droplets are ejected and is formed with a plurality of ink pressure chambers in a one-to-one correspondence with the plurality of nozzle holes. The ink channel unit includes a diaphragm that defines part of each ink pressure chamber. The plurality of piezoelectric elements is aligned in an alignment direction and is provided in a one-to-one correspondence with the plurality of ink pressure chambers. Each piezoelectric element has one end fixed to the base member and another end attached to the diaphragm. Each piezoelectric element generates displacement in a displacement direction for deforming the diaphragm to eject ink droplets through a corresponding one of the plurality of nozzle holes. The dynamic vibration absorber is mounted on the base member for damping vibrations of the base member due to a resonance, the resonance occurring in a frequency range less than or equal to a predetermined frequency.

According to another aspect, the present invention provides an inkjet recording device. The inkjet recording device includes an inkjet recording head and a driving unit. The inkjet recording head includes a base member, an ink channel unit, a plurality of piezoelectric elements, and a dynamic vibration absorber. The ink channel unit is formed with a plurality of nozzle holes through which ink droplets are ejected and is formed with a plurality of ink pressure chambers in a one-to-one correspondence with the plurality of nozzle holes. The ink channel unit includes a diaphragm that defines part of each ink pressure chamber. The plurality of piezoelectric elements is aligned in an alignment direction and is provided in a one-to-one correspondence with the plurality of ink pressure chambers. Each piezoelectric element has one end fixed to the base member and another end attached to the diaphragm. Each piezoelectric element generates displacement in a displacement direction for deforming the diaphragm to eject ink droplets through a corresponding one of the plurality of nozzle holes. The dynamic vibration absorber is mounted on the base member for damping vibrations of the base member due to a resonance, the resonance occurring in a frequency range less than or equal to a predetermined frequency. The driving unit applies drive pulse signals to the plurality of piezoelectric elements, allowing the base member to be vibrated by the plurality of piezoelectric elements at a frequency less than or equal to the predetermined frequency.

BRIEF DESCRIPTION OF THE DRAWINGS

The above and other objects, features and advantages of the invention will become more apparent from reading the following description of the preferred embodiments taken in connection with the accompanying drawings in which:

FIG. 4(*b*) is a graph showing sample frequency characteristics with respect to vibrational displacement of the base member, when the vibration absorbing portion is mounted on the ink droplet ejecting portion;

FIG. 5(*b*) is an operational model equivalent to the recording head shown in FIG. 5(*a*);

DETAILED DESCRIPTION OF THE EMBODIMENTS

An inkjet recording head and an inkjet recording device according to an embodiment of the present invention will be described while referring to the accompanying drawings.

Figure 1:
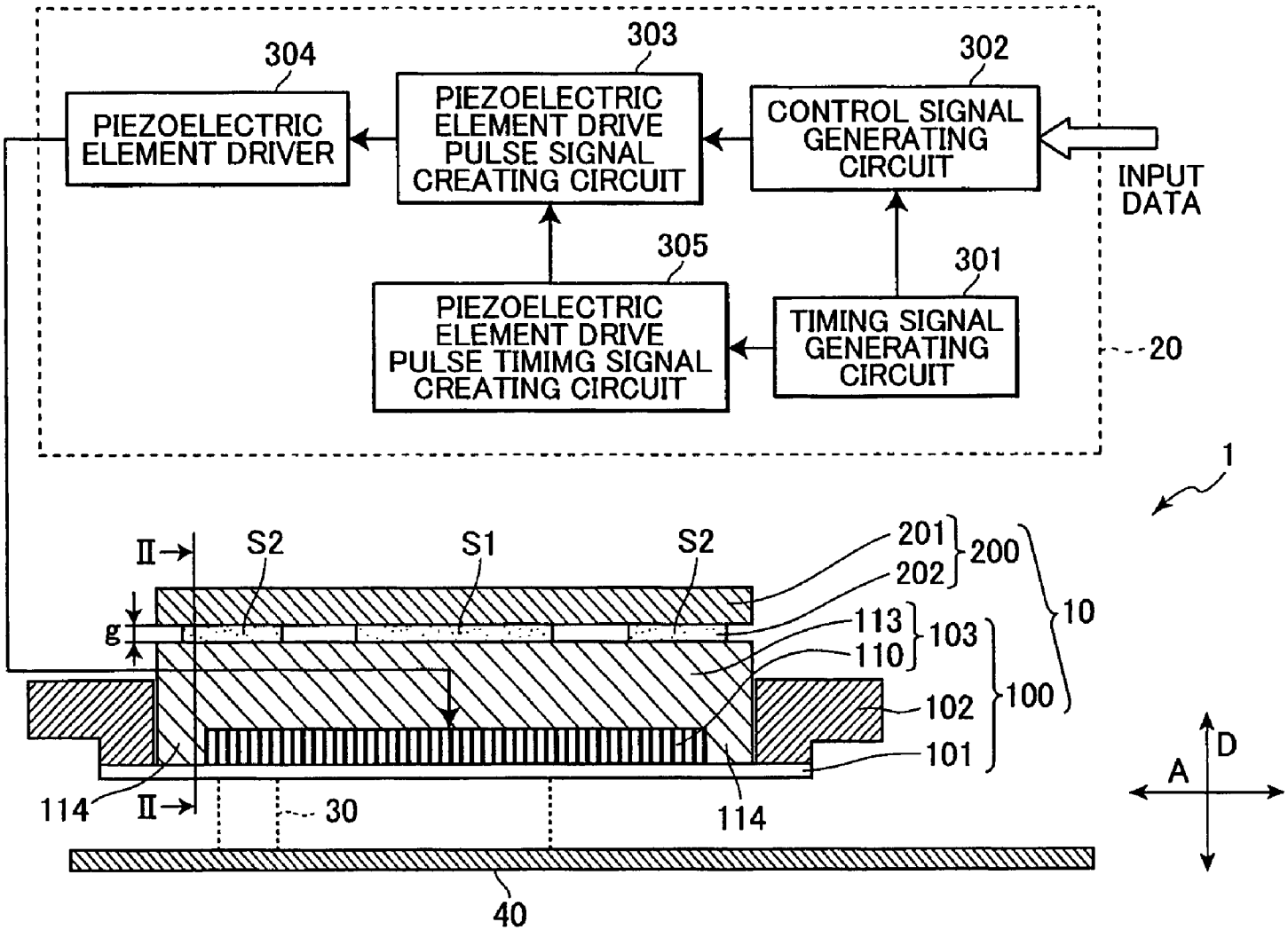
FIG. 1 is a cross-sectional view and a block diagram illustrating the construction of an inkjet recording device according to an embodiment of the present invention.
Figure 2:
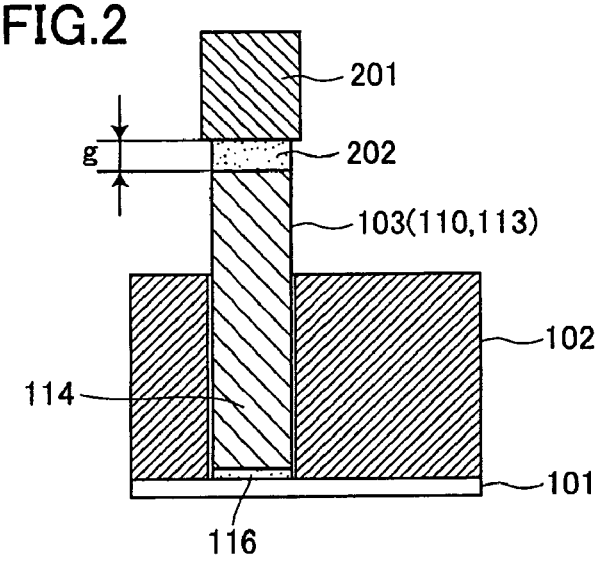
FIG. 2 is a cross-sectional view taken along a line II-II of FIG. 1, for particularly showing a vibration absorbing portion and an ink droplet ejecting portion of an inkjet recording head according to the embodiment.
Figure 3:
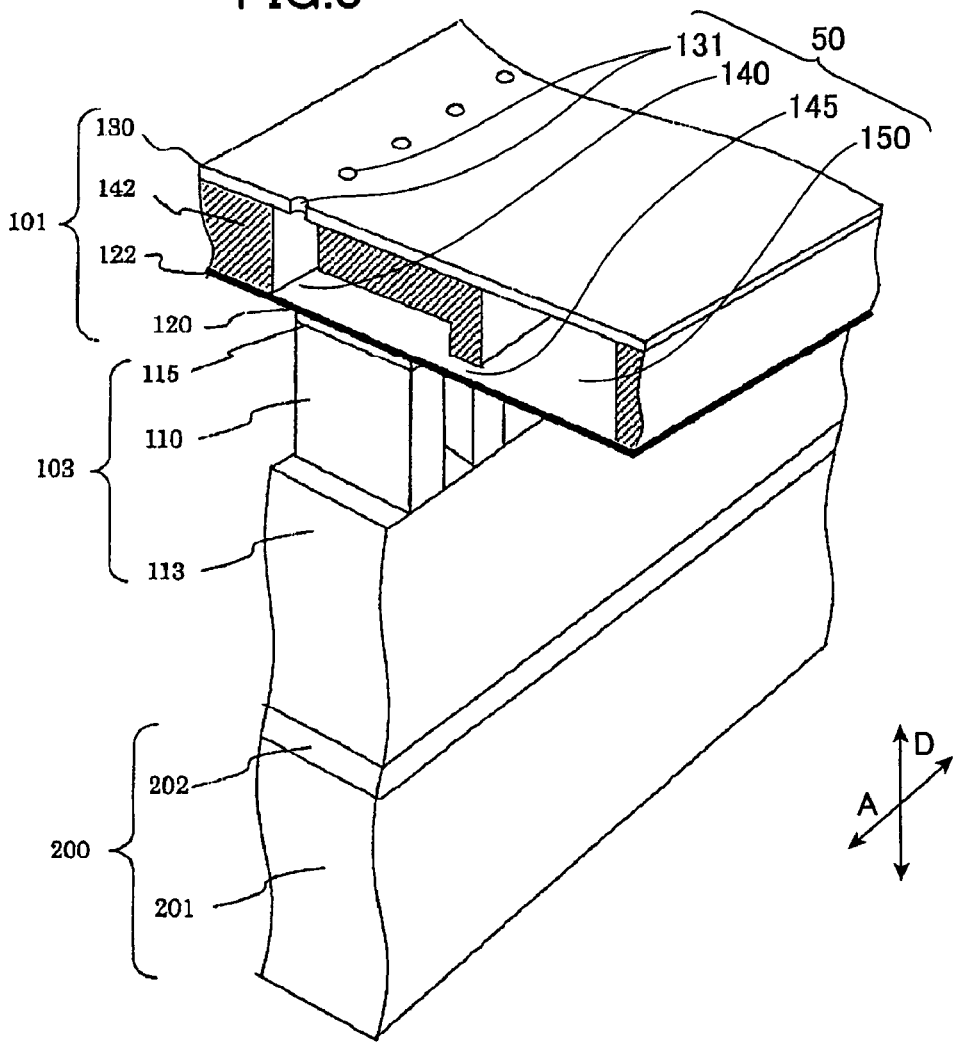
FIG. 3 is a perspective view of the inkjet recording head according to the embodiment.

FIG. 1 is a cross-sectional view and block diagram illustrating the construction and operations of a recording device according to the present embodiment. FIG. 2 is a cross-sectional view taken along a line II-II in FIG. 1 (that is, a cross-section in a direction orthogonal to the cross-section of the recording head in FIG. 1) FIG. 3 is an enlarged perspective view illustrating the construction and operations of a portion of the recording head.

As shown in FIG. 1, an inkjet recording device 1 according to the embodiment includes a recording head 10 and a recording head driving unit 20. The recording head 10 includes an ink droplet ejecting portion 100 and a vibration absorbing portion 200. The ink droplet ejecting portion 100 is capable of ejecting ink droplets 30 onto a recording medium 40 such as recording paper, cloth, substrate, and the like.

First, the construction and operations of the ink droplet ejecting portion 100 will be described. As shown in FIGS. 1 and 2, the ink droplet ejecting portion 100 includes an ink channel unit 101, a recording head housing 102 holding the ink channel unit 101, and a piezoelectric element unit 103. As shown in FIG. 3, the ink channel unit 101 is formed by laminating and fixing an orifice plate 130, an ink channel forming plate 142, and a diaphragm forming plate 122 together in the order given. The piezoelectric element unit 103 is formed by fixing bar-shaped piezoelectric elements 110 to a base member 113 in a configuration similar to the teeth of a comb. With this construction, n nozzle elements 50 are formed in the ink droplet ejecting portion 100.

More specifically, the nozzle elements 50 include a row of n nozzle holes 131 that is formed as orifices in the orifice plate 130, such that the nozzle holes 131 are spaced at predetermined intervals. The nozzle elements 50 further include an ink pressure chamber 140 in fluid communication with the nozzle holes 131, an ink inlet 145 for guiding ink to the ink pressure chamber 140, and a common ink chamber 150 for supplying ink to the ink inlet 145.

By fixing the diaphragm forming plate 122 to the ink channel forming plate 142, a diaphragm 120 forms at least one surface of the ink pressure chamber 140. One end of the piezoelectric elements 110 is attached to the diaphragm 120 on the opposite side from the ink pressure chamber 140. In other words, the tips of the piezoelectric elements 110 abut the diaphragm 120 and are fixed to the diaphragm 120 by an adhesive layer 115. Each nozzle has an identical structure Each piezoelectric element 110 is capable of generating displacement in a displacement direction D for deforming the diaphragm 120 to change a volume in the corresponding ink pressure chamber 140 and to eject ink droplets through the corresponding nozzle hole 131.

As shown in FIG. 1, the piezoelectric element 110 of each nozzle element is fixed by an adhesive or the like to the base member 113 to construct the piezoelectric element unit 103. Columnar fixing portions 114 for fixing the base member 113 are disposed on both ends of the base member 113 with respect to an alignment direction A in which the piezoelectric elements are aligned. A bottom surface of the fixing portions 114 is fixed to the ink channel unit 101 by an adhesive layer 116 (FIG. 2). Since the ink channel unit 101 is fixed by adhesive to the housing 102 near the region that the fixing portion 114 is bonded to the ink channel unit 101, the bottom surface of the fixing portion 114 is fixed in position with respect to the housing 102.

The ink droplet ejecting portion 100 having the above-described construction is driven by signals transmitted from the driving unit 20. As shown in FIG. 1, the driving unit 20 includes a timing signal generating circuit 301, a control signal generating circuit 302, a piezoelectric element drive pulse signal creating circuit 303, a piezoelectric element driver 304, and a piezoelectric element drive pulse timing signal creating circuit 305.

The timing signal generating circuit 301 is connected to both the control signal generating circuit 302 and the piezoelectric element drive pulse timing signal creating circuit 305, and supplies a timing source signal to the control signal generating circuit 302 and the piezoelectric element drive pulse timing signal creating circuit 305.

The control signal generating circuit 302 produces control signals based both on the timing source signal supplied from the timing signal generating circuit 301 and on input data received from a host device, such as a personal computer (not shown).

The piezoelectric element drive pulse timing signal creating circuit 305 creates a timing signal based on the timing source signal supplied from the timing signal generating circuit 301, and supplies the timing signal to the piezoelectric element drive pulse signal creating circuit 303.

The piezoelectric element drive pulse signal creating circuit 303 creates a pulse signal for driving the piezoelectric elements based on the control signal received from the control signal generating circuit 302 and on the timing signal received from the piezoelectric element drive pulse timing signal creating circuit 305. This pulse signal is amplified to a suitable power for enabling the piezoelectric element driver 304 to drive each of the piezoelectric elements 110. The frequency of the pulse signal created by the piezoelectric element drive pulse signal creating circuit 303 is set to less than or equal to a maximum value of fmax, based on the timing signal supplied from the piezoelectric element drive pulse timing signal creating circuit 305. Hence, the ink droplet ejecting portion 100 is driven by the driving unit 20, whose piezoelectric element drive pulse is set to less than or equal to a maximum frequency fmax.

One feature of the recording head 10 according to the present embodiment is the vibration absorbing portion 200 mounted on the ink droplet ejecting portion 100. Next, the construction and operations of the vibration absorbing portion 200 will be described.

As shown in FIGS. 1 through 3, the vibration absorbing portion 200 includes a rod-shaped rigid member 201 and an elastic member (flexible member) 202. The rigid member 201 is mounted on the base member 113 with the elastic member 202 interposed therebetween and on the opposite side of the base member 113 from the side on which the piezoelectric elements 110 are mounted. The rigid member 201 is configured of a metal such as a stainless steel, a ceramic, or the like and has a predetermined mass m.

The elastic member 202 is an epoxy adhesive or the like having a pliable but stiff property. The elastic member 202 is disposed to cover a predetermined adhesive area and to form a predetermined gap (thickness) between the rigid member 201 and the base member 113. More specifically, as shown in FIG. 1, the elastic member 202 is mounted in three locations as an adhesive area S1 in the center portion and adhesive areas S2 in the end portions, forming a gap (thickness) g between the rigid member 201 and the base member 113. In this way, the total spring coefficient of the elastic member 202 linking the rigid member 201 and the base member 113 is set at a predetermined value k. An example of the vibration absorbing portion developed by the inventors of the present invention has a mass m of approximately 5 gram, a gap (thickness) g of 0.4 mm (millimeter), an adhesive area S1 of 0.5 $cm^2$ (square centimeter) in the center portion, and adhesive areas S2 of 0.2 $cm^2$ at the end portions.

The mass m of the rigid member 201 and the spring coefficient k of the elastic member 202 can be determined according to the maximum frequency fmax that is determined by the piezoelectric element drive pulse timing signal creating circuit 305 described above.

Next, the operations and effects of the vibration absorbing portion 200 will be described with reference to FIGS. 4(*a*) through 5(*b*).

Figure 4A:
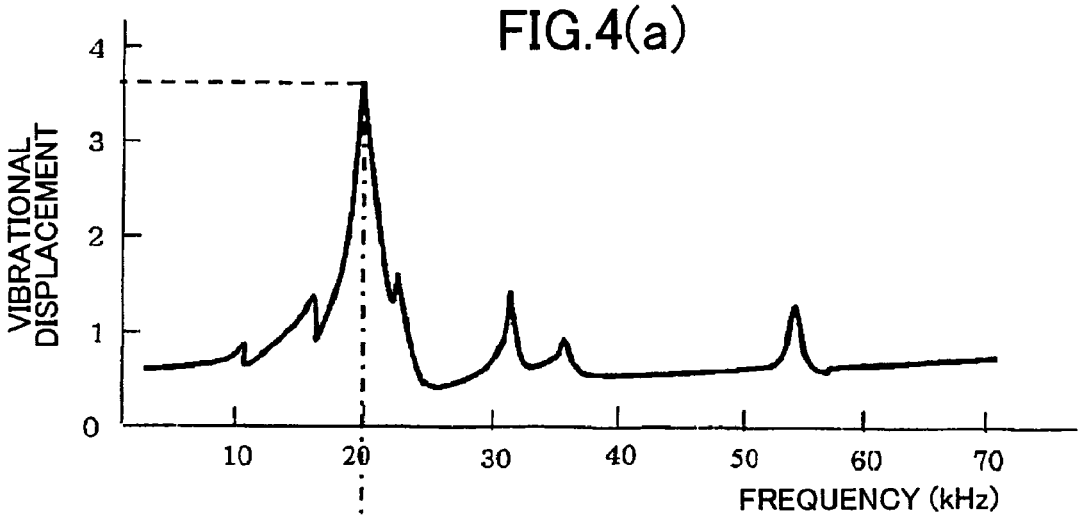
FIG. 4(*a*) is a graph showing sample frequency characteristics with respect to vibrational displacement of a base member, when the vibration absorbing portion is not mounted on the ink droplet ejecting portion.
Figure 4B:
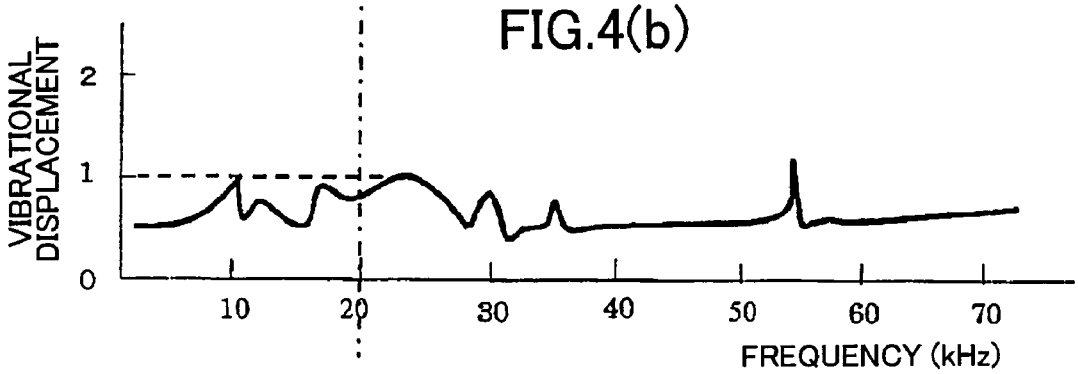

The graphs in FIGS. 4(*a*) and 4(*b*) show sample frequency characteristics with respect to vibrational displacement of the base member 113, wherein the horizontal axis indicates the frequency of a sine wave driving signal at a constant voltage that is applied to the piezoelectric elements 110, while the vertical axis indicates the amount of vibrational displacement in the base member 113 in the expanding direction of the piezoelectric elements 110.

More specifically, FIG. 4(*a*) shows frequency characteristics when the vibration absorbing portion 200 is not mounted on the ink droplet ejecting portion 100. FIG. 4(*b*) shows frequency characteristics when the vibration absorbing portion 200 is mounted on the ink droplet ejecting portion 100.

FIG. 4(*a*) shows that the amount of vibrational displacement increases dramatically around 20 kHz. This increase is due to resonance The resonance is caused by a primary resonating system (main mass-spring system) shown in FIGS. 5(*a*) and 5(*b*). Specifically, a mechanical resonance system configured of the housing 102 having a mass M0 linked to the piezoelectric element unit 103 having a mass M1 by the adhesive layer 116 with a spring coefficient K resonates when vibrated by the piezoelectric elements 110. As shown in the equivalent circuit of FIG. 5(*b*), since the mass M0 of the housing 102 is sufficiently larger than the mass M1 of the piezoelectric element unit 103, the adhesive layer 116 in the circuit is approximated as a spring having one fixed end. In the present embodiment, the mass m of the rigid member 201 is set substantially equal to the mass M1 of the base member 113.

When driving a recording head having the resonance characteristics described above with a recording head driving unit having a piezoelectric element driving pulse set to a maximum frequency of 20 kHz, vibrations due to the resonance generate large vibrations in the base member 113. Vibrations due to the resonance are transferred to ink in the ink chamber, causing abnormal vibrations in the meniscus and, thus, degrading the reliability of recording high-quality images at a high speed. For example, mist may be generated from the ink when ejecting ink droplets. The trajectory of the ink droplets may deviate from a predetermined ejecting direction. Alternatively, the ink may leak from the nozzle hole and wet the region around the hole, resulting in ejection failure.

Figure 5A:
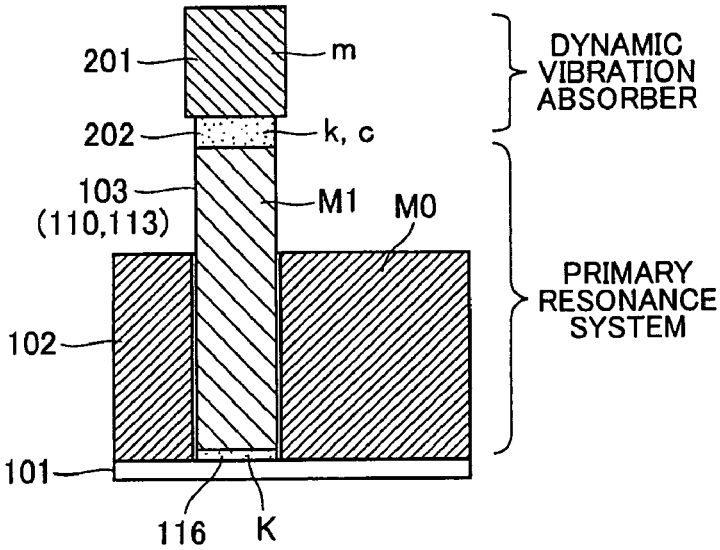
FIG. 5(*a*) is a cross-sectional view of the recording head according to the embodiment.
Figure 5B:
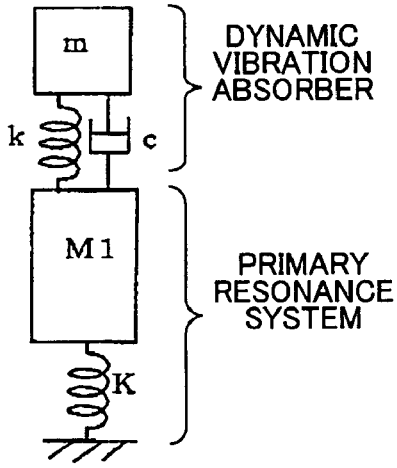

In FIG. 4(*b*), the amount of vibrational displacement in the 20 kHz region peaks at less than one-third that in FIG. 4(*a*), because a dynamic vibration absorber was mounted on the primary resonance system, as shown in FIG. 5. The dynamic vibration absorber dampens resonance at 20 kHz, which is the maximum value for the frequency of the piezoelectric element driving pulse. Specifically, the mass m of the rigid member 201 and the spring coefficient k of the elastic member 202 are set so as to dampen the resonance at 20 kHz. Accordingly, the rigid member 201 generates a dynamic drag of an opposite phase to the base member 113 at the resonance frequency, and the damping effect of the elastic member 202 having a coefficient of viscous damping c dampens vibrations in the base member 113.

Hence, the above-described construction eliminates abnormal vibrations in the meniscus, enabling stable ink ejection and, hence, enabling high-speed, high-quality image recording with excellent reliability.

The inkjet recording head according to the above-described embodiment can dampen abnormal vibrations in the base member that have an adverse effect on recording quality, thereby eliminating abnormal vibration of the meniscus and establishing stable ink droplet ejection. Hence, the inkjet recording head can provide an inkjet recording device capable of recording high-quality images at a high speed with excellent reliability.

Further, with the inkjet recording head according to the above-described embodiment, the same adhesive is used as the material in the elastic member 202 and the adhesive layer 116. Accordingly, even if the adhesive undergoes changes over time or changes due to temperature, such as an increase in hardness over the passage of time or changes in hardness due to temperature changes, the spring coefficient k of the elastic member 202 and the spring coefficient K of the adhesive layer 116 will change with the same characteristics. Hence, the dynamic vibration absorber according to the embodiment can well withstand changes over time and changes in temperature.

While the invention has been described in detail with reference to the specific embodiment thereof, it would be apparent to those skilled in the art that various changes and modifications may be made therein without departing from the spirit of the invention.

For example, in the above-described embodiment, the mass m of the rigid member 201 is set substantially equal to the mass M1 of the base member 113. However, by modifying the adhesive areas S1 and S2 at which the rigid member 201 is adhered to the base member 113 and the gap (thickness) g therebetween to achieve an optimal spring coefficient k, it is possible to configure a dynamic vibration absorber that can dampen resonance at a desired frequency Further, in the above-described embodiment, as shown in FIG. 1, the rigid member 201 is mounted in three locations on the base member 113 over predetermined adhesive areas (adhesive areas S1 and S2) and separated by a predetermined gap (gap g). With this construction, the damping characteristics of the dynamic vibration absorber may be measured after affixing the rigid member 201 and forming the elastic member 202. If the spring coefficient k of the elastic member 202 is too high, the bonded adhesive area can easily be adjusted to an appropriate amount by inserting a cutter or other tool into the gap and cutting away a portion of the elastic member 202.

Further, the shape of and the number of locations for the elastic member 202 may be different from those described in the above-described embodiment. For example, the elastic member 202 may be formed across the entire surface on the top end of the base member 113.

Further, the shape of the rigid member 201 and the positions at which the rigid member 201 is mounted on the base member 113 may be modified in various ways.

Figure 6:
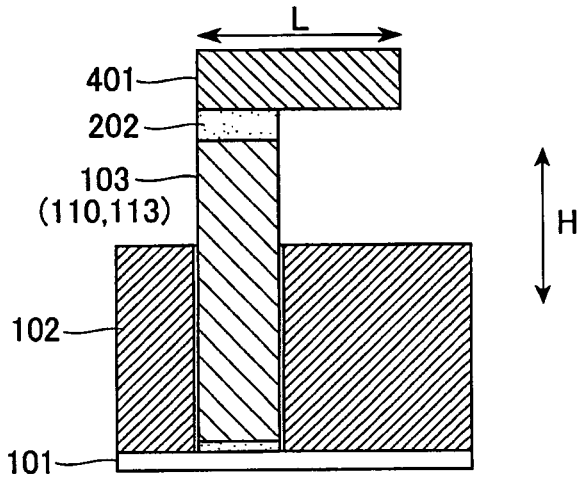
FIG. 6 is a cross-sectional view illustrating a dynamic vibration absorber of an inkjet recording head according to a modification in which a rigid member has a relatively flat shape.

For example, FIG. 6 shows a vibration absorbing portion which includes a rigid member 401 having a relatively flat shape. The rigid member 401 is fixed to the base member 113 such that a longitudinal direction L of the rigid member 401 is substantially perpendicular to a height direction H. Accordingly, the height of the rigid member 401 is decreased, thereby reducing the amount that the overall height of the recording head is increased when mounting the rigid member 401.

Figure 7:
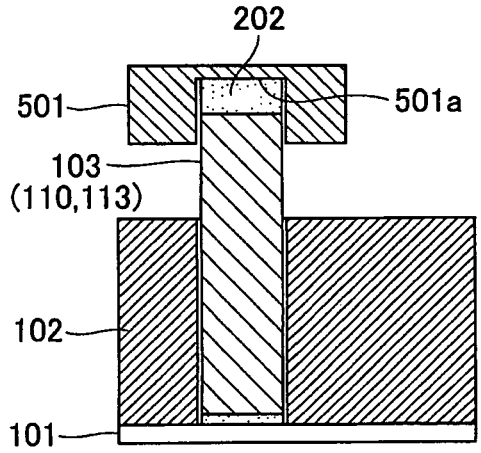
FIG. 7 is a cross-sectional view illustrating a dynamic vibration absorber of an inkjet recording head according to another modification in which a rigid member has a concave portion.

FIG. 7 shows a vibration absorbing portion which includes a rigid member 501 having a concave portion 501*a*. The base member 113 is fixed to the concave portion 501*a*. Accordingly, the height of the rigid member 501 is substantially decreased, thereby reducing the amount that the overall height of the recording head is increased when mounting the rigid member 501.

Figure 8:
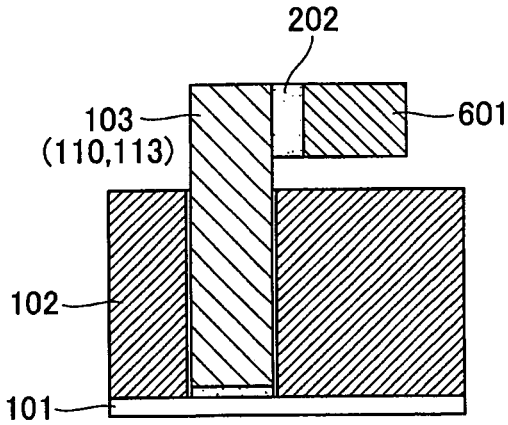
FIG. 8 is a cross-sectional view illustrating a dynamic vibration absorber of an inkjet recording head according to another modification in which a rigid member is fixed to a side surface of a base member.

The vibration absorbing portion shown in FIG. 8 has a rigid member 601 fixed to the side surface of the base member 113, thereby further suppressing an increase in the height of the recording head.

Figure 9:
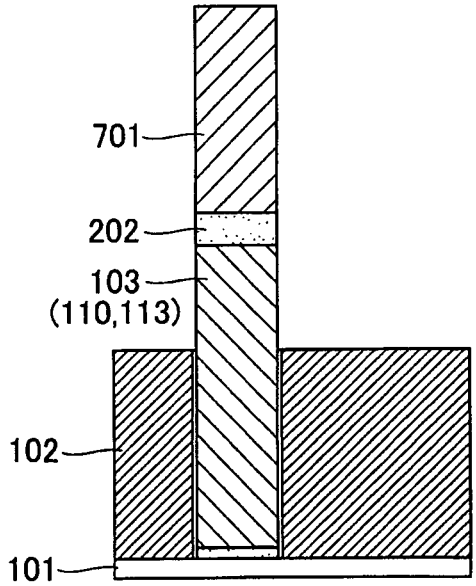
FIG. 9 is a cross-sectional view illustrating a dynamic vibration absorber of an inkjet recording head according to another modification in which a rigid member is formed in the same shape and of the same material as the base member.

In a modification shown in FIG. 9, a rigid member 701 is formed in the same shape and of the same material as the base member 113, facilitating the matching of vibrational properties between the rigid member 701 and base member 113 to improve damping characteristics.

Figure 10:
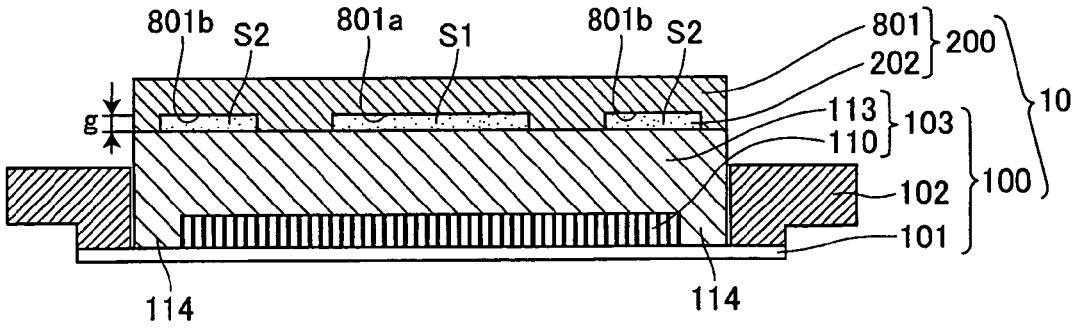
FIG. 10 is a cross-sectional view illustrating a dynamic vibration absorber of an inkjet recording head according to another modification in which indentations are formed in a rigid member and an elastic member is formed in the indentations.
Figure 11:
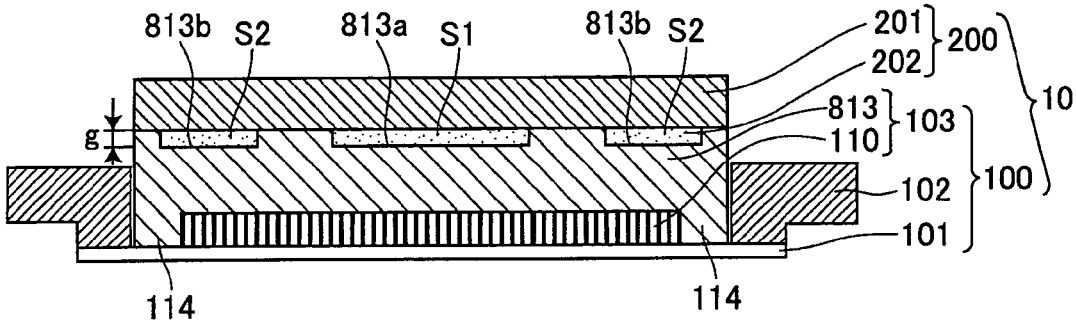
FIG. 11 is a cross-sectional view illustrating a dynamic vibration absorber of an inkjet recording head according to another modification in which indentations are formed in a base member and an elastic member is formed in the indentations.

In a modification shown in FIG. 10, indentations 801*a* and 801*b* are formed in a rigid member 801, and the elastic member 202 is disposed in the indentations 801*a* and 801*b*. Similarly, in a modification shown in FIG. 11, indentations 813*a* and 813*b* are formed in a base member 813, and the elastic member 202 is disposed in the indentations 813*a* and 813*b*. Since the adhesive areas of the elastic members are defined by the indentations 801*a* and 801*b* or the indentations 813*a* and 813*b*, the spring coefficient k of the elastic member 202 can easily be set to a design value.

Figure 12:
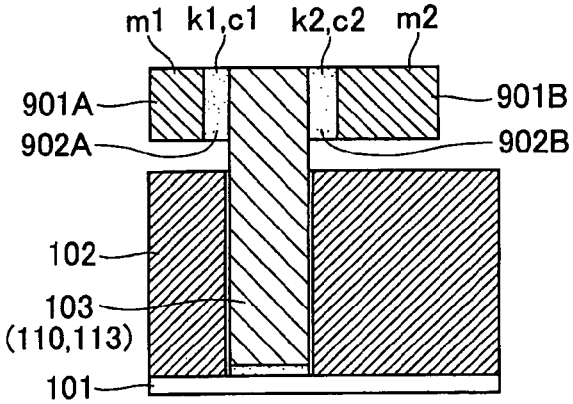
FIG. 12 is a cross-sectional view illustrating a dynamic vibration absorber of an inkjet recording head according to another modification in which two rigid members and two elastic members are disposed on the base member.
Figure 13:
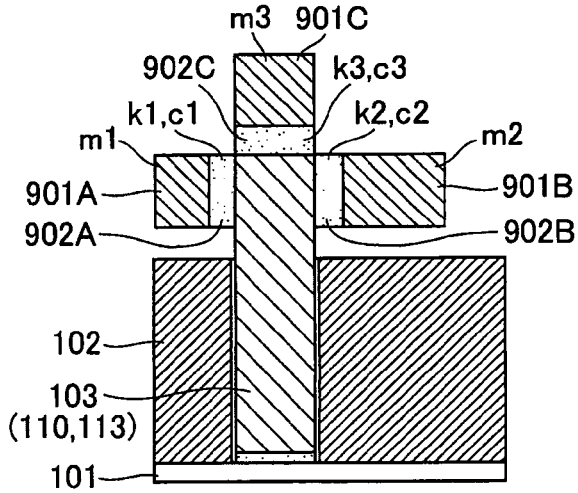
FIG. 13 is a cross-sectional view illustrating a dynamic vibration absorber of an inkjet recording head according to another modification in which three rigid members and three elastic members are disposed on the base member.

FIGS. 12 and 13 show modifications of disposing a vibration absorbing portion having a plurality of rigid members 901A, 901B, and 901C (FIG. 13) and elastic members 902A, 902B, and 902C (FIG. 13) on the base member 113. Hence, the vibration absorbing portion can be tuned to two resonance frequencies (FIG. 12) or three resonance frequencies (FIG. 13) in order to dampen each of these frequencies.

Figure 14:
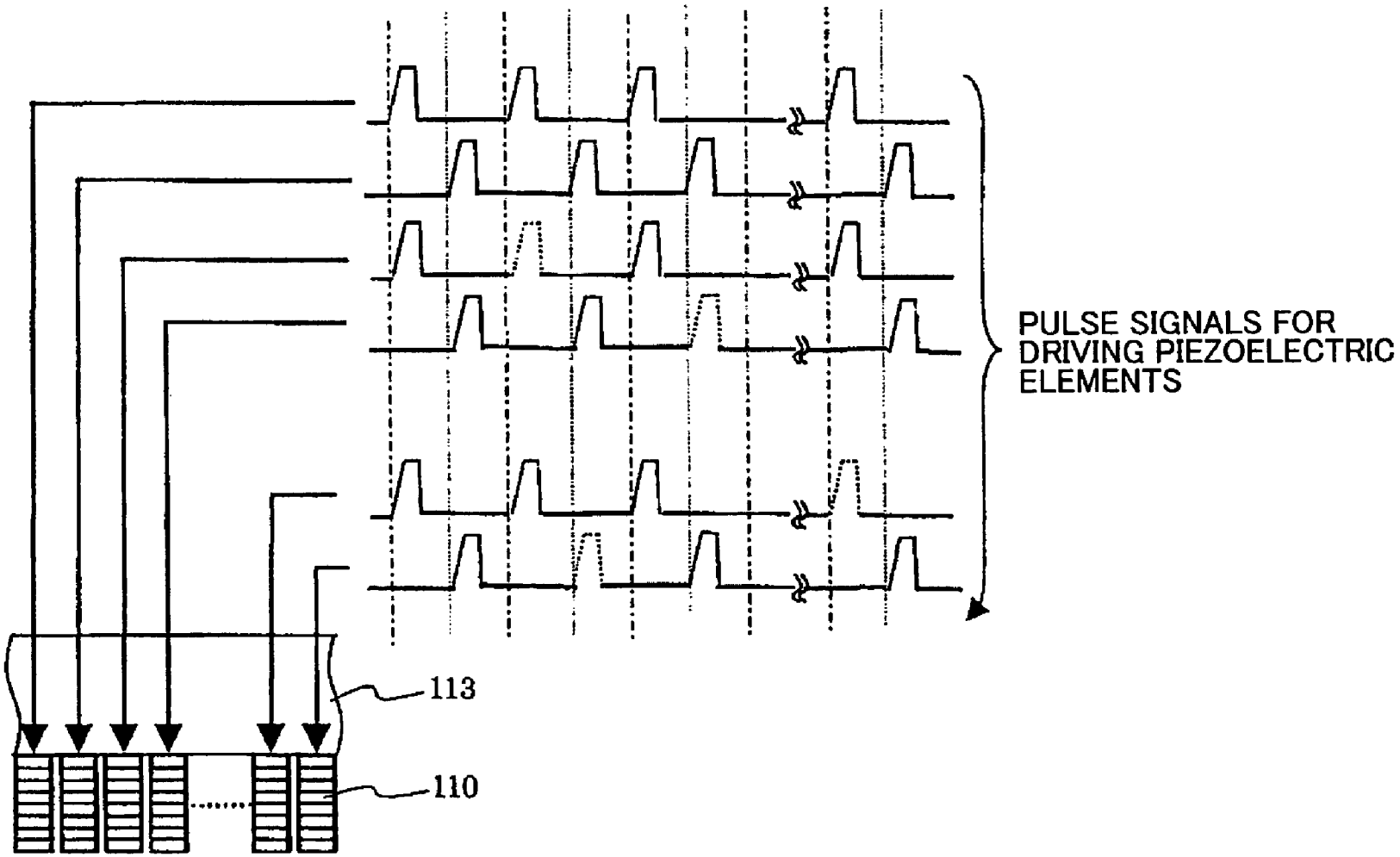
FIG. 14 is an explanatory diagram according to another modification, illustrating a method of driving piezoelectric elements with two-phase pulse signals.

FIG. 14 illustrates a modification when the piezoelectric elements 110 are driven by a two-phase pulse signal in order to reduce cross talk and the like. In this example, the vibrational frequency that the piezoelectric elements 110 apply to the base member 113 is two times a frequency f of the pulse signals used to drive the piezoelectric elements. Therefore, the maximum drive frequency of the pulse signals generated by the driving unit 20 is set to one-half the frequency used when the piezoelectric elements 110 are driven by single-phase pulse signals. In other words, the maximum drive frequency of the pulse signals is set to fmax/2 in order to keep the maximum frequency that the piezoelectric elements apply to the base member 113 within fmax. Accordingly, a dynamic vibration absorber according to the present modification can dampen vibrations caused by resonance in the base member 113 in a frequency region that is less than or equal to fmax, and can eliminate abnormal vibrations in the base member 113. Hence, the dynamic vibration absorber can ensure stable ink ejection, thereby achieving high-quality image recording at high speeds with excellent reliability. Further, when the piezoelectric elements 110 are driven by n-phase pulse signals, the maximum drive frequency of the pulse signals generated by the driving unit 20 is set to 1/n the frequency used to drive the piezoelectric elements 110 with a single-phase pulse signal. Hence, the inkjet recording device according to the present modification include the driving unit in which the drive frequency of a pulse signal for driving piezoelectric elements is set such that the maximum frequency at which the piezoelectric elements vibrate the base member is less than or equal to fmax; and the dynamic vibration absorber that is mounted on the base member for damping frequencies due to resonance in the base member occurring at a frequency range that is less than or equal to fmax.

The recording head provided in the inkjet recording device according to the above-described embodiment and modifications is suitable for a serial scanning inkjet recording device or a line scanning inkjet recording device.

In the serial scanning inkjet recording device, the recording head according to the above-described embodiment and modifications is disposed so that the surface of the orifice plate confronts the recording paper. The recording head ejects ink droplets according to recording signals, while being moved in a main scan, that is, laterally in a direction orthogonal to the longitudinal direction of the continuous recording paper. After recording each line, the recording paper is conveyed a predetermined distance in a sub-scanning direction equivalent to the longitudinal direction of the continuous recording paper, and the image for the subsequent line is recorded in the main scanning direction. The entire image is recorded by repeatedly recording in the main scanning direction while conveying the paper in the sub-scanning direction.

In the line scanning inkjet recording device, multiple recording heads according to the above-described embodiment and modifications are disposed across the width of the continuous recording paper so as to confront the recording paper across the entire width. While the recording heads eject ink droplets according to recording signals, the recording paper is simultaneously moved at a high speed in the longitudinal direction of the continuous recording paper (main scanning direction). Dot formation in scan lines is controlled by controlling the main scanning and the ejection of ink droplets to form a recorded image on the paper. In this way, the inkjet recording device can print high-quality images at a high speed.

The inkjet recording head according to the above-described embodiment and modifications is not limited to an inkjet recording device that records images in ink on recording paper, but may be applied to an industrial liquid distributing device such as a device for marking products, a coating device, and the like.

What is claimed is:

1. An inkjet recording head comprising:

a housing member;

a base member;

an ink channel unit supported by the housing member and formed with a plurality of nozzle holes through which ink droplets are ejected and formed with a plurality of ink pressure chambers in a one-to-one correspondence with the plurality of nozzle holes, the ink channel unit including a diaphragm that defines part of each ink pressure chamber;

a plurality of piezoelectric elements aligned in an aligned in alignment direction and provided in a one-to-one correspondence with the plurality of ink pressure chambers, each piezoelectric element having one end fixed to the base member and another end attached to the diaphragm, each piezoelectric element generating displacement in a displacement direction for deforming the diaphragm to eject ink droplets through a corresponding one of the plurality of nozzle holes; and a dynamic vibration absorber mounted on the base member, wherein the base member isolates the dynamic vibration absorber from the housing member, for damping vibrations of the base member to a resonance occurring in a frequency range less than or equal to a predetermined frequency, wherein the dynamic vibration absorber comprises a rigid member, and wherein an elastic member mounts the rigid member on the base member, wherein the base member has a first end a second end opposite to each other in the displacement direction, wherein the plurality of piezoelectric elements is fixed to the first end, wherein the rigid member is connected to the second end via the elastic member, wherein the base member has an elongated shape extending in the alignment direction and has a predetermined mass, wherein the rigid member has an elongated shape extending in the alignment direction and has a predetermined mass, wherein the elastic member comprises a plurality of flexible adhesive layers arranged in the alignment direction, each flexible adhesive layer having a predetermined thickness and an adhesive area, and wherein the rigid member is fixed to the base member via the plurality of flexible adhesive layers.

2. The inkjet head of claim 1, wherein the rigid member comprises a plurality of elongated rigid members fixed to a plurality of locations on the base member.

3. The inkjet head of claim 1, wherein the predetermined frequency is a maximum frequency of drive pulse signals applied to the plurality of piezoelectric elements.

4. An inkjet recording head comprising:

a housing member;

a base member;

an ink channel unit supported by the housing member and formed with a plurality of nozzle holes through which ink droplets are ejected and formed with a plurality of ink pressure chambers in a one-to-one correspondence with the plurality of nozzle holes, the ink channel unit including a diaphragm that defines part of each ink pressure chamber;

a plurality of piezoelectric elements aligned in an aligned in alignment direction and provided in a one-to-one correspondence with the plurality of ink pressure chambers, each piezoelectric element having one end fixed to the base member and another end attached to the diaphragm, each piezoelectric element generating displacement in a displacement direction for deforming the diaphragm to eject ink droplets through a corresponding one of the plurality of nozzle holes; and a dynamic vibration absorber mounted on the base member, wherein the base member isolates the dynamic vibration absorber from the housing member, for damping vibrations of the base member to a resonance occurring in a frequency range less than or equal to a predetermined frequency, wherein the dynamic vibration absorber comprises a rigid member, and wherein an elastic member mounts the rigid member on the base member, wherein at least one of the rigid member and the base member is formed with an indentation, and wherein the elastic member is disposed in the indentation.

5. The inkjet recording head of claim 4, wherein the elastic member is a flexible adhesive and has a predetermined thickness and an adhesive area.

6. The inkjet head of claim 4, wherein the rigid member comprises a plurality of elongated rigid members fixed to a plurality of locations on the base member.

7. The inkjet head of claim 4, wherein the predetermined frequency is a maximum frequency of drive pulse signals applied to the plurality of piezoelectric elements.

8. An inkjet recording device comprising:

an inkjet recording head including:

a housing member;

a base member;

an ink channel unit supported by the housing member and formed with a plurality of nozzle holes through which ink droplets are ejected and formed with a plurality of ink pressure chambers in a one-to-one correspondence with the plurality of nozzle holes, the ink channel unit including a diaphragm that defines part of each ink pressure chamber;

a plurality of piezoelectric elements aligned in an aligned in alignment direction and provided in a one-to-one correspondence with the plurality of ink pressure chambers, each piezoelectric element having one end fixed to the base member and another end attached to the diaphragm, each piezoelectric element generating displacement in a displacement direction for deforming the diaphragm to eject ink droplets through a corresponding one of the plurality of nozzle holes; and a dynamic vibration absorber mounted on the base member, wherein the base member isolates the dynamic vibration absorber from the housing member, for damping vibrations of the base member due to a resonance occurring in a frequency range less than or equal to a predetermined frequency; and a driving unit arranged to apply drive pulse signals to the plurality of piezoelectric elements, allowing the base member to be vibrated by the plurality of piezoelectric elements at a frequency less than or equal to the predetermined frequency wherein the dynamic vibration absorber comprises a rigid member, wherein an elastic member mounts the rigid member on the base member, wherein at least one of the rigid member and the base member is formed with an indentation, and wherein the elastic member is disposed in the indentation.

9. The inkjet recording device of claim 8, wherein the base member has a first end a second end opposite to each other in the displacement direction;

wherein the plurality of piezoelectric elements is fixed to the first end of the base member; and wherein the rigid member is connected to the second end of the base member via the elastic member.

10. The inkjet recording device of claim 8, wherein the elastic member is a flexible adhesive and has a predetermined thickness and an adhesive area.

11. The inkjet recording device of claim 8, wherein the driving unit applies n-phase drive pulse signals to the plurality of piezoelectric elements, where n is a natural number greater than or equal to two; and wherein the drive pulse signals have a frequency less than or equal to 1/n of the predetermined frequency.

12. The inkjet recording device of claim 8, wherein the predetermined frequency is a maximum frequency of the drive pulse signals.

13. An inkjet recording device comprising:

an inkjet recording head including:

a housing member;

a base member;

an ink channel unit supported by the housing member and formed with a plurality of nozzle holes through which ink droplets are ejected and formed with a plurality of ink pressure chambers in a one-to-one correspondence with the plurality of nozzle holes, the ink channel unit including a diaphragm that defines part of each ink pressure chamber;

a plurality of piezoelectric elements aligned in an aligned in alignment direction and provided in a one-to-one correspondence with the plurality of ink pressure chambers, each piezoelectric element having one end fixed to the base member and another end attached to the diaphragm, each piezoelectric element generating displacement in a displacement direction for deforming the diaphragm to eject ink droplets through a corresponding one of the plurality of nozzle holes; and a dynamic vibration absorber mounted on the base member, wherein the base member isolates the dynamic vibration absorber from the housing member, for damping vibrations of the base member due to a resonance occurring in a frequency range less than or equal to a predetermined frequency; and a driving unit arranged to apply drive pulse signals to the plurality of piezoelectric elements, allowing the base member to be vibrated by the plurality of piezoelectric elements at a frequency less than or equal to the predetermined frequency wherein the dynamic vibration absorber comprises a rigid member, wherein an elastic member mounts the rigid member on the base member, wherein the mid member has an elongated shape extending in the alignment direction and has a predetermined mass, wherein the elastic member comprises a plurality of adhesive layers arranged in the alignment direction, and wherein the rigid member is fixed to the base member via the plurality of adhesive layers.

14. The inkjet recording device of claim 13, wherein the driving unit applies n-phase drive pulse signals to the plurality of piezoelectric elements, where n is a natural number greater than or equal to two; and wherein the drive pulse signals have a frequency less than or equal to 1/n of the predetermined frequency.

15. The inkjet recording device of claim 13, wherein the predetermined frequency is a maximum frequency of the drive pulse signals.

* * * * *